US011731386B2

(12) United States Patent
Kolodziey et al.

(10) Patent No.: US 11,731,386 B2
(45) Date of Patent: Aug. 22, 2023

(54) SYSTEM AND METHOD FOR PROCESSING CASE AND CARTON BLANKS

(71) Applicant: Wayne Automation Corporation, Norristown, PA (US)

(72) Inventors: John Kolodziey, Norristown, PA (US); John Wasyliw, Norristown, PA (US); Joseph L Bachman, Jr., Norristown, PA (US); Joseph L Bachman, III, Norristown, PA (US)

( * ) Notice: Subject to any disclaimer, the term of this patent is extended or adjusted under 35 U.S.C. 154(b) by 60 days.

(21) Appl. No.: 17/088,370

(22) Filed: Nov. 3, 2020

(65) Prior Publication Data

US 2022/0134700 A1 May 5, 2022

(51) Int. Cl.

| | |
|---|---|
| ***B31B 50/62*** | (2017.01) |
| ***B31B 50/26*** | (2017.01) |
| *B31B 100/00* | (2017.01) |

(52) U.S. Cl.

CPC ..... *B31B 50/624* (2017.08); *B31B 50/262* (2017.08); *B31B 2100/00* (2017.08)

(58) Field of Classification Search

CPC ..... B31B 2120/302; B31B 2100/0024; B31B 50/26; B31B 50/624; B31B 50/52; B31B 50/62; B31B 50/622; B65B 5/024; B65B 43/08; B65B 57/10; B65B 59/00; B65B 59/001; B65B 2210/04

USPC ..... 53/396, 456, 493, 503, 504, 66; 493/51, 493/52, 68, 70, 79

See application file for complete search history.

(56) References Cited

U.S. PATENT DOCUMENTS

| | | | | |
|---|---|---|---|---|
| 5,400,955 | A * | 3/1995 | Coalier | B31B 50/52 229/116 |
| 7,329,218 | B2 * | 2/2008 | Kisch | B65H 5/085 493/309 |
| 10,273,042 | B1 * | 4/2019 | Kolodziey | B31B 50/003 |
| 2004/0168408 | A1 * | 9/2004 | Spatafora | B65B 43/185 53/566 |
| 2013/0184135 | A1 * | 7/2013 | Duer | B31B 50/741 493/162 |

(Continued)

OTHER PUBLICATIONS

International Plastics, "How It's Made—Cardboard Boxes," Aug. 7, 2013, YouTube Video, URL: https://www.youtube.com/watch?v=HL2yvqSk8Ww (Year: 2013).*

(Continued)

*Primary Examiner* — Andrew M Tecco
*Assistant Examiner* — Jacob A Smith

(57) ABSTRACT

A system and method for forming knock-down blanks from die-cut flat blanks used for forming shipping cartons or cases, comprising positioning a flat blank in a forming device, wherein the flat blank has four panels each with a middle portion, a top flap hingeably connected to the middle portion and a bottom flap hingeably connected to the middle portion, wherein the fourth panel has a tab formed on the outer edge of its middle portion, wherein the forming device includes a first mechanically operated arm and a second mechanically operated arm, wherein the first arm contacts the first panel, and wherein the second arm contacts the fourth panel; applying adhesive to the tab; and using the first and second arms to fold the first and fourth panels 180° inward, wherein the adhesive on the tab joins the first and fourth panels together.

10 Claims, 14 Drawing Sheets

(56) References Cited

U.S. PATENT DOCUMENTS

| | | | | |
|---|---|---|---|---|
| 2015/0034711 | A1* | 2/2015 | Pinkstone | B65D 5/6608 493/309 |
| 2018/0086019 | A1* | 3/2018 | Langen | B65B 5/024 |

OTHER PUBLICATIONS

Georgia-Pacific, "Corrugated Boxes: How It's Made Step By Step Process | Georgia-Pacific," Mar. 16, 2015, YouTube Video, URL: https://www.youtube.com/watch?v=C5nNUPNvWAw (Year: 2015).*

* cited by examiner

SYSTEM AND METHOD FOR PROCESSING CASE AND CARTON BLANKS

BACKGROUND

The disclosed inventive subject matter relates in general to industrial systems and processes for assembling containers and more specifically to an automated system and method for forming or partially forming cases or cartons for use in commerce.

Folding cases and cartons are well known in the packaging art. These cartons are typically constructed from flat blanks which are pre-cut and pre-scored on paperboard sheets. Carton blanks usually have four main panels which are adapted to form the top, bottom, and sides of an assembled carton. Each panel includes a pair of end flaps that are flexibly connected to the panel by score lines formed in the paperboard. Assembly of blanks into cases or cartons is often a fully automated process that may require specific equipment and machinery, and which may be complex, thereby potentially creating problems with consistency and quality control. Prior art systems and devices, such as that disclosed in U.S. Pat. No. 3,101,654 typically employ the use of a device referred to as a mandrel, which is solid or semi-solid square or rectangular form, around which cardboard or other materials are wrapped to create the desired shape of the final product (e.g. shipping carton or case). The use of mandrels form forming cartons or cases is effective, but requires complex machinery and adds considerable expense to the carton or case forming process. Accordingly, a more simplistic system and method for forming cartons or cases from blanks that does not require the use of a mandrel is desirable.

SUMMARY

The following provides a summary of certain example implementations of the disclosed inventive subject matter. This summary is not an extensive overview and is not intended to identify key or critical aspects or elements of the disclosed inventive subject matter or to delineate its scope. However, it is to be understood that the use of indefinite articles in the language used to describe and claim the disclosed inventive subject matter is not intended in any way to limit the described inventive subject matter. Rather the use of "a" or "an" should be interpreted to mean "at least one" or "one or more".

One implementation provides a method for forming case blanks from flat blanks, comprising providing a flat blank, wherein the flat blank includes a first panel, wherein the first panel includes a middle portion, a top flap hingeably connected to the middle portion and a bottom flap hingeably connected to the middle portion; a second panel, wherein the second panel includes a middle portion, a top flap hingeably connected to the middle portion and a bottom flap hingeably connected to the middle portion; a third panel, wherein the third panel includes a middle portion, a top flap hingeably connected to the middle portion and a bottom flap hingeably connected to the middle portion; and a fourth panel, wherein the fourth panel includes a middle portion having a tab formed on the outer edge thereof, a top flap hingeably connected to the middle portion, and a bottom flap hingeably connected to the middle portion; applying adhesive to the tab; and folding the first and fourth panels 180° inward toward one another such that the adhesive on the tab adheres the first and fourth panels to one another.

The method may further comprise using a flat blank wherein the first and third panels have the same width and wherein the second and fourth panels have the same width and wherein the width of the second and fourth panels is either greater than the width of the first and third panels, less than the width of the first and third panels, or the same as the width of the first and third panels. The method may further comprise using a forming device to fold the panels, wherein the forming device includes a first mechanically operated arm; and a second mechanically operated arm, wherein the first arm contacts the first panel, and wherein the second arm contacts the fourth panel. The forming device may further comprise a first (e.g., vertical) support upon which a second (e.g., horizontal) support is mounted, and wherein the first mechanically operated arm and a second mechanically operated arm are both rotatably mounted on the horizontal support. The forming device may further comprise a gripping assembly mounted on the support for retaining the flat blank during the folding process. The first mechanically operated arm and the second mechanically operated arm may each be driven in an inward direction by motors or other force-producing devices mounted the horizontal support. The method may further comprise using a thermoplastic material as the adhesive, although any other type of suitable adhesive may be used. The method may further comprise using a mechanical device to apply the adhesive to the tab. The flat blank may be die-cut or fabricated from any other suitable process or technique.

Another implementation provides a first automated system for forming case blanks from flat blanks, comprising positioning a die-cut flat blank in a forming device, wherein the flat blank includes a first panel, wherein the first panel includes a middle portion, a top flap hingeably connected to the middle portion and a bottom flap hingeably connected to the middle portion; a second panel, wherein the second panel includes a middle portion, a top flap hingeably connected to the middle portion and a bottom flap hingeably connected to the middle portion; a third panel, wherein the third panel includes a middle portion, a top flap hingeably connected to the middle portion and a bottom flap hingeably connected to the middle portion; and a fourth panel, wherein the fourth panel includes a middle portion having a tab formed on the outer edge thereof, a top flap hingeably connected to the middle portion, and a bottom flap hingeably connected to the middle portion; wherein the forming device includes a first mechanically operated arm; and a second mechanically operated arm, wherein the first arm contacts the first panel, and wherein the second arm contacts the fourth panel; applying adhesive to the tab; and actuating the forming device such that the first and second arms fold the first and fourth panels 180° inward toward one another and wherein the adhesive on the tab adheres the first and fourth panels to one another.

The system may further comprise using a flat blank wherein the first and third panels have the same width and wherein the second and fourth panels have the same width and wherein the width of the second and fourth panels is either greater than the width of the first and third panels, less than the width of the first and third panels, or the same as the width of the first and third panels. The system may further comprise a vacuum device or other type of device for transporting the flat blank to the forming device and a mechanical device for applying the adhesive. The adhesive may include a thermoplastic material, although any other type of suitable adhesive may be used. The forming device may be integrated into a case processing apparatus. The forming device may further include a first (vertical) support upon which a second (horizontal) support is mounted, wherein the first mechanically operated arm and a second mechanically operated arm are both rotatably mounted on the horizontal support, and wherein the first mechanically operated arm and the second mechanically operated arm are each driven in an inward direction by motors or other force-producing devices mounted the horizontal support. The system may further comprise a gripping assembly mounted on the support of the forming device for retaining the flat blank during the folding process.

Still another implementation provides a second automated system for forming case blanks from flat blanks, comprising positioning a flat, die-cut blank in a forming device that has been integrated into a case processing apparatus, wherein the flat blank includes a first panel, wherein the first panel includes a middle portion, a top flap hingeably connected to the middle portion and a bottom flap hingeably connected to the middle portion; a second panel, wherein the second panel includes a middle portion, a top flap hingeably connected to the middle portion and a bottom flap hingeably connected to the middle portion; a third panel, wherein the third panel includes a middle portion, a top flap hingeably connected to the middle portion and a bottom flap hingeably connected to the middle portion; and a fourth panel, wherein the fourth panel includes a middle portion having a tab formed on the outer edge thereof, a top flap hingeably connected to the middle portion, and a bottom flap hingeably connected to the middle portion; and wherein the forming device includes a first (e.g., vertical) support upon which a second (e.g., horizontal) support is mounted; a first mechanically operated arm rotatably mounted on the horizontal support; a second mechanically operated arm rotatably mounted on the horizontal support, wherein the first mechanically operated arm and the second mechanically operated arm are each driven in an inward direction by motors or other force-producing devices mounted the horizontal support; and wherein the first arm contacts the first panel, and wherein the second arm contacts the fourth panel; applying thermoplastic adhesive (or other suitable type of adhesive) to the tab; and actuating the forming device such that the first and second arms fold the first and fourth panels 180° inward toward one another and wherein the adhesive on the tab adheres the first and fourth panels to one another.

The system may further comprise using a flat blank wherein the first and third panels have the same width and wherein the second and fourth panels have the same width and wherein the width of the second and fourth panels is either greater than the width of the first and third panels, less than the width of the first and third panels, or the same as the width of the first and third panels. The system may further comprise a vacuum device or other type of device for transporting the flat blank to the forming device and a mechanical device for applying the adhesive. The system may further comprise a gripping assembly mounted on the support of the forming device for retaining the flat blank during the folding process.

It should be appreciated that all combinations of the foregoing concepts and additional concepts discussed in greater detail below (provided such concepts are not mutually inconsistent) are contemplated as being part of the inventive subject matter disclosed herein and may be implemented to achieve the benefits as described herein. Additional features and aspects of the disclosed system, devices, and methods will become apparent to those of ordinary skill in the art upon reading and understanding the following detailed description of the example implementations. As will be appreciated by the skilled artisan, further implementations are possible without departing from the scope and spirit of what is disclosed herein. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more example implementations of the disclosed inventive subject matter and, together with the general description given above and detailed description given below, serve to explain the principles of the disclosed subject matter, and wherein.

DETAILED DESCRIPTION

Figure 1A:
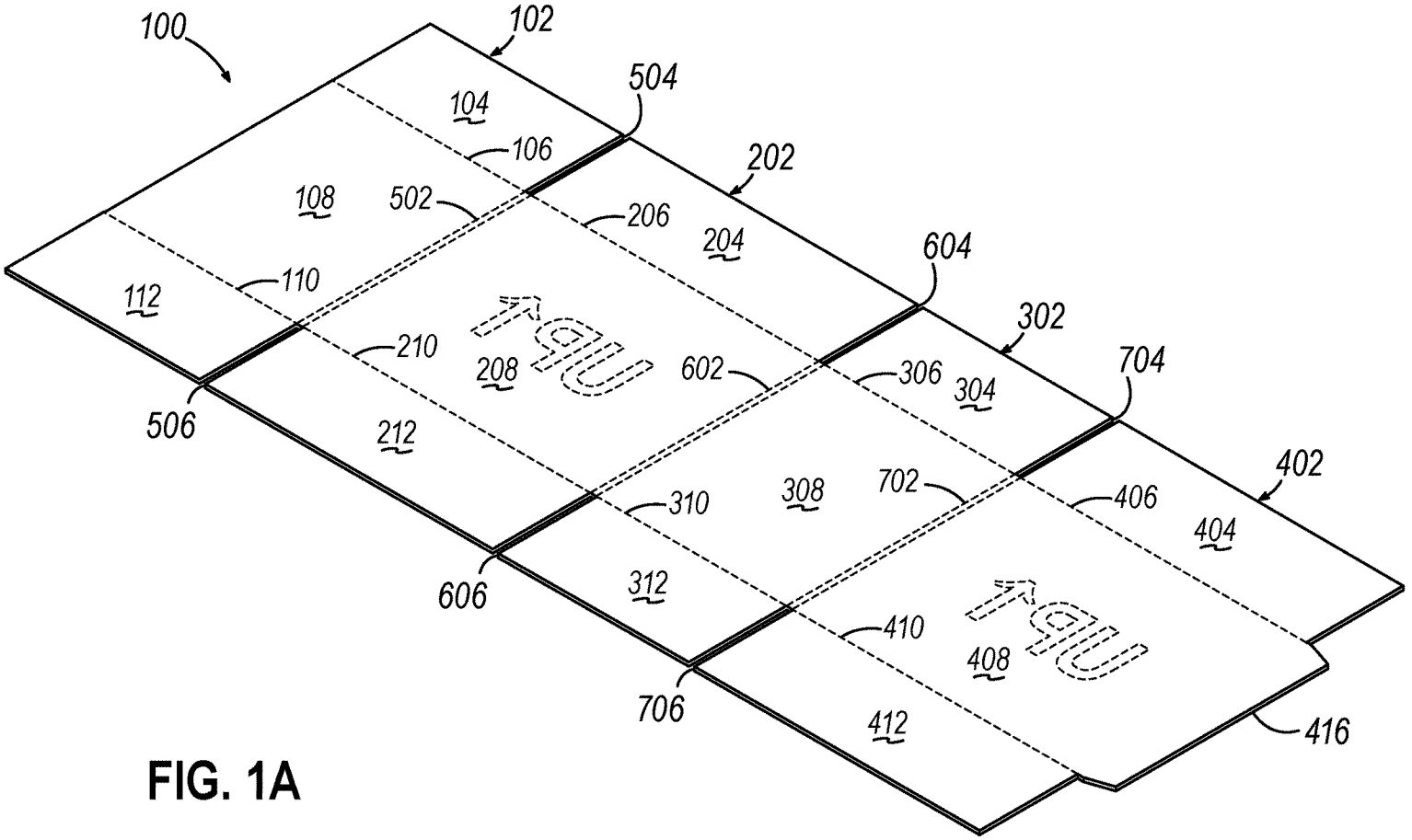
FIG. 1A is a front, perspective view of an example flat (unopened) case blank used with the disclosed case forming system and method.

Example implementations are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the disclosed inventive subject matter. Accordingly, the following implementations are set forth without any loss of generality to, and without imposing limitations upon, the claimed subject matter.

Example implementations disclosed herein provide a system and method for folding case blanks of corrugated box materials into a formed case which may ultimately be partially or entirely filled with merchandise, food, or other items. Although this system and method may be used for more than one type of case blank, the example case blank shown in the Figures is die cut and includes four separate panels (attached to one another in a hinged manner), two of which are major and two of which are minor, thus resulting in a rectangular case or carton 800 when the blank is folded into its final configuration. More specifically, as shown in FIG. 1, case blank 100 includes first (minor) panel 102, second (major) panel 202, third (minor) panel 302, and fourth (major) panel (402).

Figure 1B:
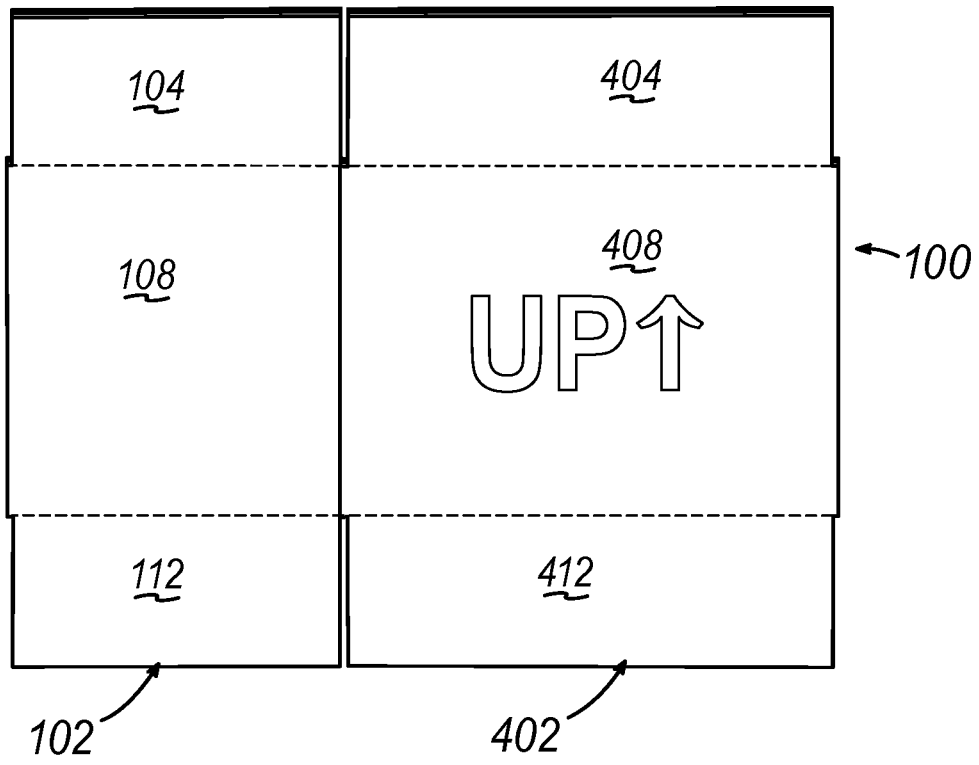
FIG. 1B is a front view of an example "knock-down" blank made in accordance with the disclosed systems and methods.

As best shown in FIG. 1A, first panel 102 includes minor top flap 104, minor middle section 108, and minor bottom flap 112. Score line 106 divides minor top flap 104 from minor middle section 108 and score line 110 divides minor middle section 108 from minor bottom flap 112. Second panel 202 includes major top flap 204, major middle section 208, and major bottom flap 212. Score line 206 divides major top flap 204 from major middle section 208 and score line 210 divides major middle section 208 from major bottom flap 212. Third panel 302 includes minor top flap 304, minor middle section 308, and minor bottom flap 312. Score line 306 divides minor top flap 304 from minor middle section 308 and score line 310 divides minor middle section 308 from minor bottom flap 312. Fourth panel 402 includes major top flap 404, major middle section 408, and major bottom flap 412. Score line 406 divides major top flap 404 from major middle section 408 and score line 410 divides major middle section 408 from major bottom flap 412. Fourth panel 402 also includes manufacturer's joint tab 416 which is used to create a glued joint that connects joint tab 416 to the outer edge of minor middle section 108 on first panel 102.

Again with reference to FIG. 1A, score line 502 divides first panel 102 from second panel 202 and top gap 504 and bottom gap 506 are formed between first panel 102 and second panel 202. Score line 602 divides second panel 202 from third panel 302 and top gap 604 and bottom gap 606 are formed between second panel 202 and third panel 302. Score line 702 divides third panel 302 from fourth panel 402 and top gap 704 and bottom gap 706 are formed between third panel 302 and fourth panel 402.

Again with reference to FIG. 1B, an important aspect of the disclosed system and method is the ability to create what may be referred to as a "pre-glued knock-down blank" such as that shown in FIG. 1B, wherein first panel 102 and fourth panel 402 have been folded inward toward one another such that adhesive that has been deposited on tab 416 adheres the first and fourth panels to one another. As described below, by using a case processing apparatus that includes a mechanical forming device for creating the knock-down blank, the knock-down blank may then be formed into a carton or case that is erected and sealed on one end (see FIG. 3I) without the use of a dimension-specific internal mandrel for defining all fold-score lines inside the carton or case.

One implementation of the disclosed technology provides an automated system for forming cases or cartons from flat blanks. As described more specifically below, this system comprises stacking a predetermined number of flat blanks to a predetermined height, wherein each case blank includes a first panel, wherein the first panel includes a middle portion, a top flap hingeably connected to the middle portion and a bottom flap hingeably connected to the middle portion; a second panel, wherein the second panel includes a middle portion, a top flap hingeably connected to the middle portion and a bottom flap hingeably connected to the middle portion; a third panel, wherein the third panel includes a middle portion, a top flap hingeably connected to the middle portion and a bottom flap hingeably connected to the middle portion; and a fourth panel, wherein the fourth panel includes a middle portion having a tab formed on the outer edge thereof, a top flap hingeably connected to the middle portion, and a bottom flap hingeably connected to the middle portion, wherein the first and third panels have the same width and wherein the second and fourth panels have the same width and wherein the width of the second and fourth panels is greater than the width of the first and third panels; using a vacuum gripping device or other type of gripping device to transport a blank to a mechanical case processing apparatus; applying adhesive to the tab during the step of transporting the blank to the case processing apparatus; positioning the blank in a forming device within the case processing apparatus, wherein the forming device includes a first mechanically operated arm and a second mechanically operated arm, wherein the first arm contacts the first panel, and wherein the second arm contacts the fourth panel; actuating the forming device such that the first and second arms fold the first and fourth panels 180° inward toward one another and wherein the adhesive on the tab adheres the first and fourth panels to one another; removing the blank from the forming device and opening the blank from its flat configuration to an open configuration; folding the bottom flaps of the first and third panels upward; applying adhesive to the bottom flaps of the second and fourth panels; folding the bottom flaps of the second and fourth panels upward to adhere the bottom flaps of the second and fourth panels to the bottom flaps of the first and third panels, thereby forming a case; and removing the case from the processing apparatus. This automated system may further comprise using a vacuum gripping device or other type of gripping device to releasably secure the case blank within the forming device; using a thermoplastic material as the adhesive; using mechanical devices to apply the adhesive; using a mechanical device to open the blank from its flat configuration to an open configuration; using a mechanical device to fold the bottom flaps upward; and inserting a compression mandrel into the case after the bottom flaps have been folded upward to square the case and apply pressure to the bottom flaps for facilitating activation of the adhesive on the bottom flaps.

With reference to FIGS. 2A-C and 3A-I, initially, fully flat carton or case blanks 100 are positioned on a powered, infeed roller conveyor or the like in a single vertical column or stack up to fifty (50) inches tall. A magazine or similar device may be used to hold the stack of case blanks 100. Top flaps 104, 204, 304, and 404 are oriented in a forward or leading position and the interior surface of each case is oriented upward. All strapping, slip sheets, and overwrapping must be removed from a stack and/or the individual case blanks prior to indexing the case blanks into a case processing apparatus or machine. The case blanks are then indexed into the processing machine from the powered, infeed roller conveyor using a vertical lift mechanism. The entire stack of blanks is lifted to a known index point that is defined by the top of the stack itself. Mechanical squaring mechanisms may be used to apply force to the sides of the uppermost blanks in the stack for consistently and properly aligning the blanks as they enter the processing machine. The processing machine may operate using one or more programmable logic controllers which execute the various commands required for assembly of case blanks 100 into completed cases.

Figure 2A:
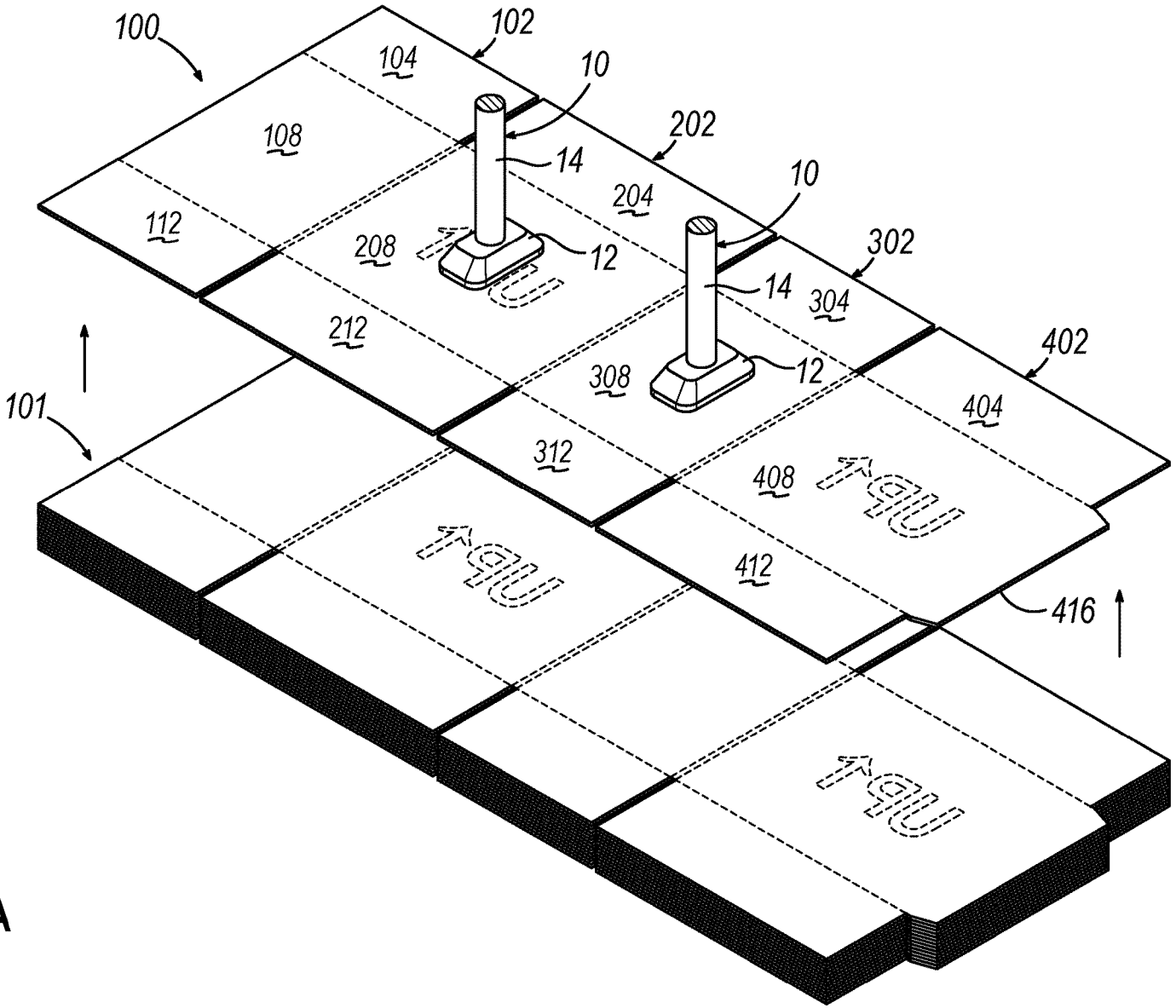
FIG. 2A depicts the case blank of FIG. 1 being lifted from a stack of case blanks by a vacuum picking device.
Figure 2B:
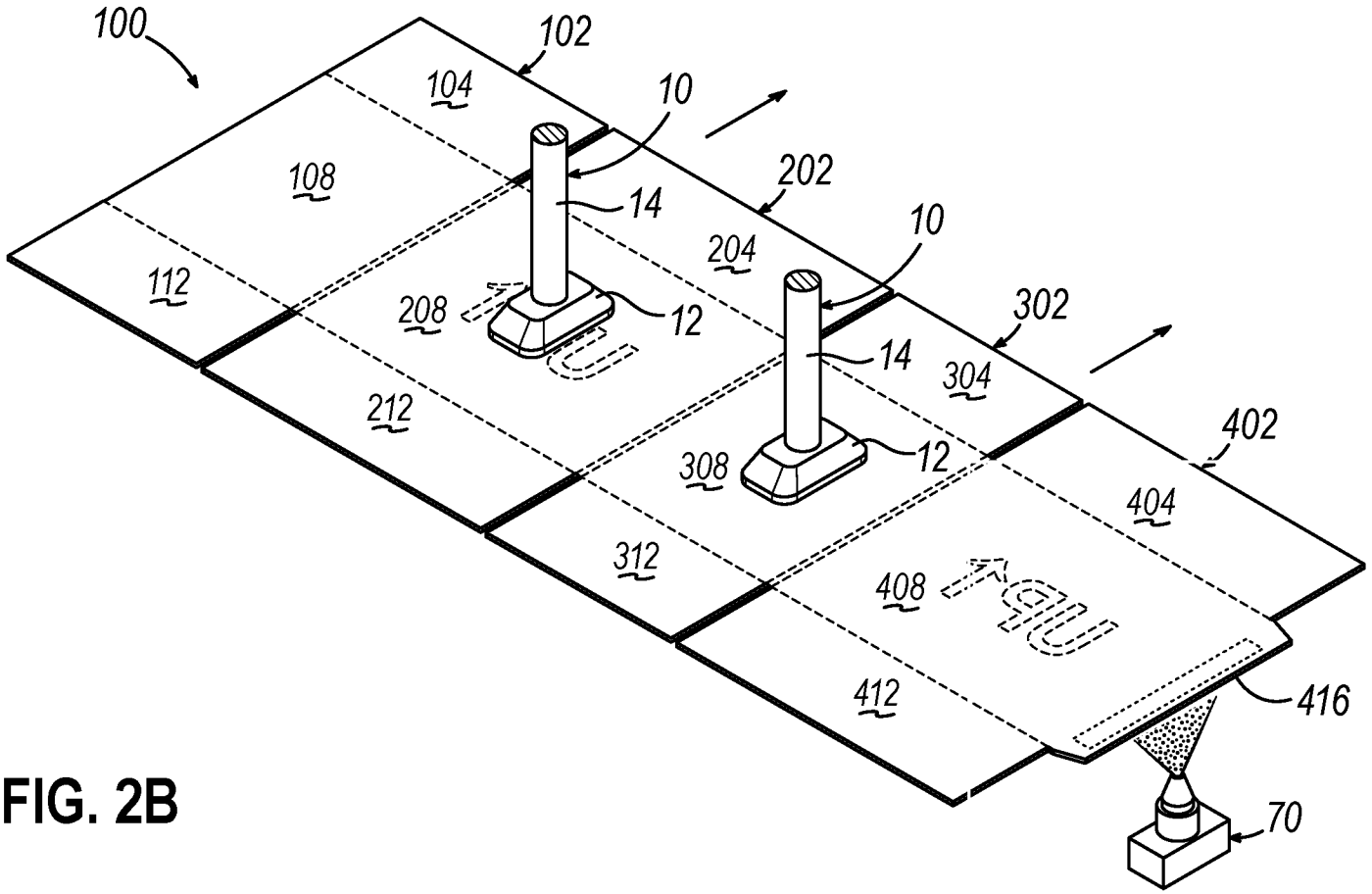
FIG. 2B depicts the case blank of FIG. 1 being transported toward a processing machine, wherein adhesive is applied to one side of a tab formed on one of the case panels during transportation.
Figure 2C:
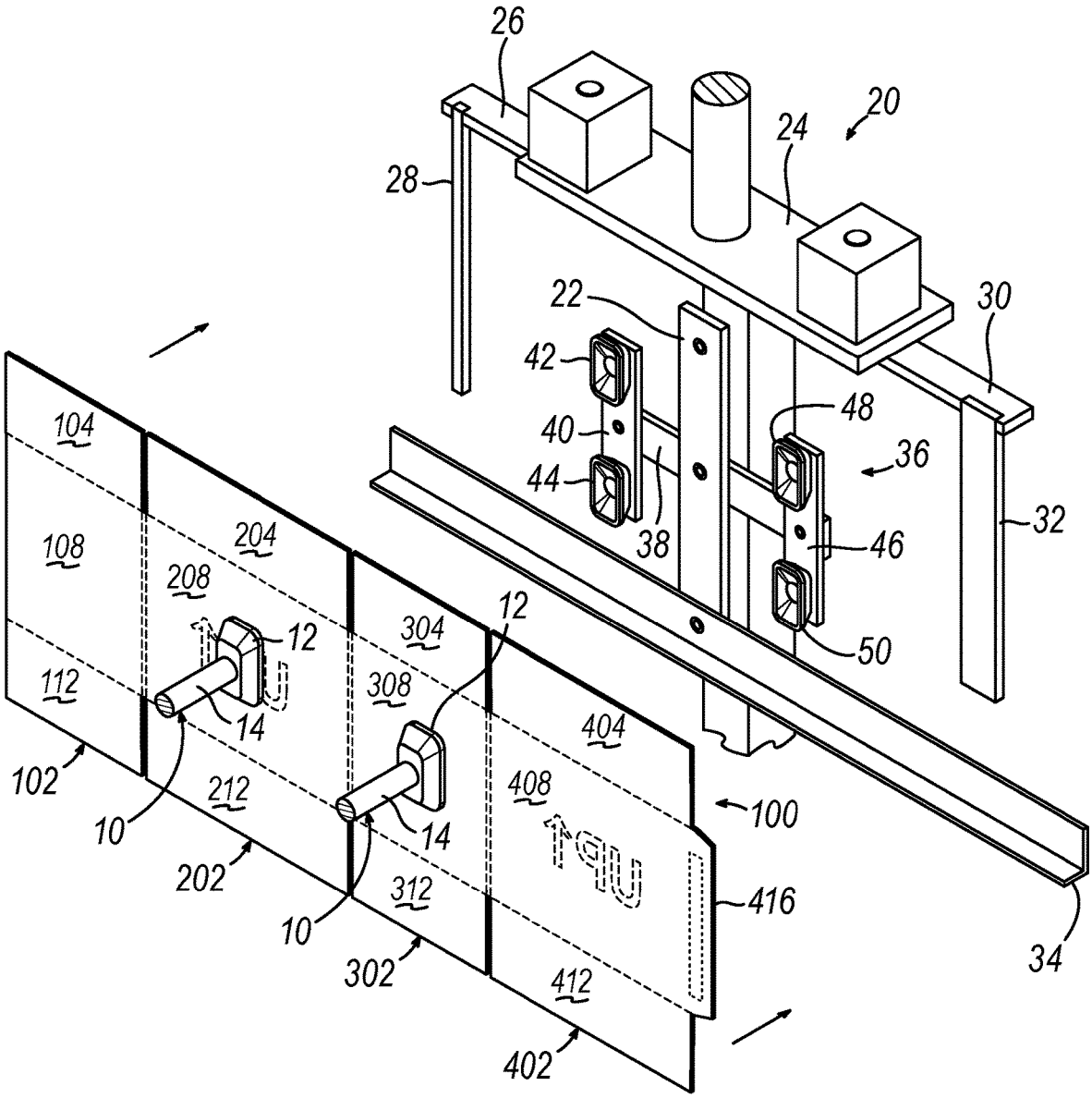
FIG. 2C depicts the case blank of FIG. 1 being placed into a forming device.

As shown in FIG. 2A the topmost case blank 100 in stack 101 is lifted off stack 101 using a picking device, which in this example includes a plurality of vacuum heads 12 connected to one or more supports 14. As shown in FIG. 2B, case blank 100 is lifted above any guiding mechanisms present on the processing machine and moved horizontally along the length thereof to a predetermined stopping point where thermoplastic adhesive (e.g., hot melt glue) is applied to manufacturer's joint tab 416 using applicator 70. As shown in FIG. 2C, case blank 100 is then rotated from a horizontal position to a vertical position and transferred from the picking device to a forming station that includes forming device 20. After case blank 100 has been transferred to forming device 20, the picking mechanism releases its vacuum and returns to the location of vertical stack 101 were it will be used to lift and transport another case blank 100.

Figure 3A:
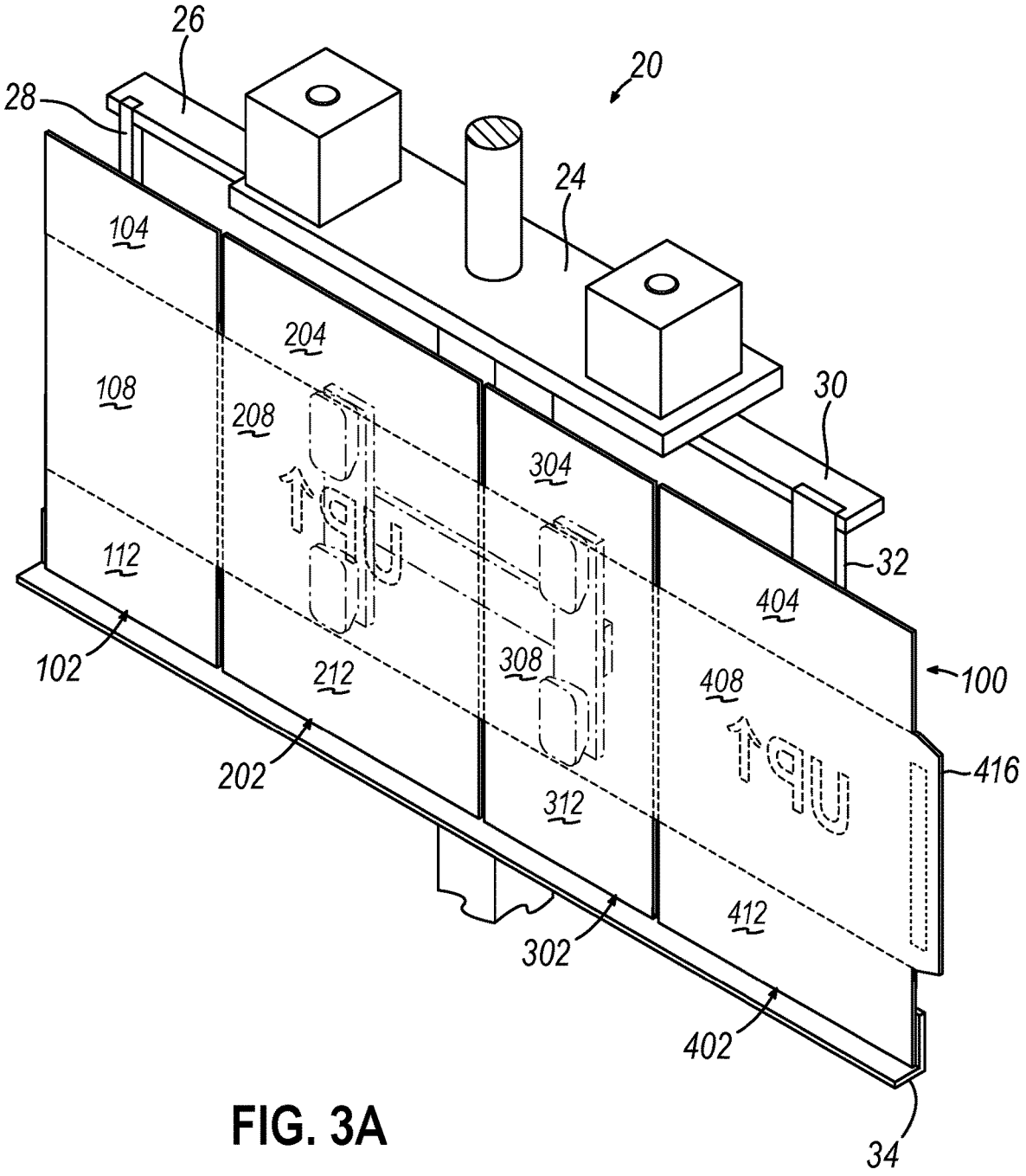
FIG. 3A depicts the case blank of FIG. 1 positioned within the forming device of FIG. 2C.
Figure 3B:
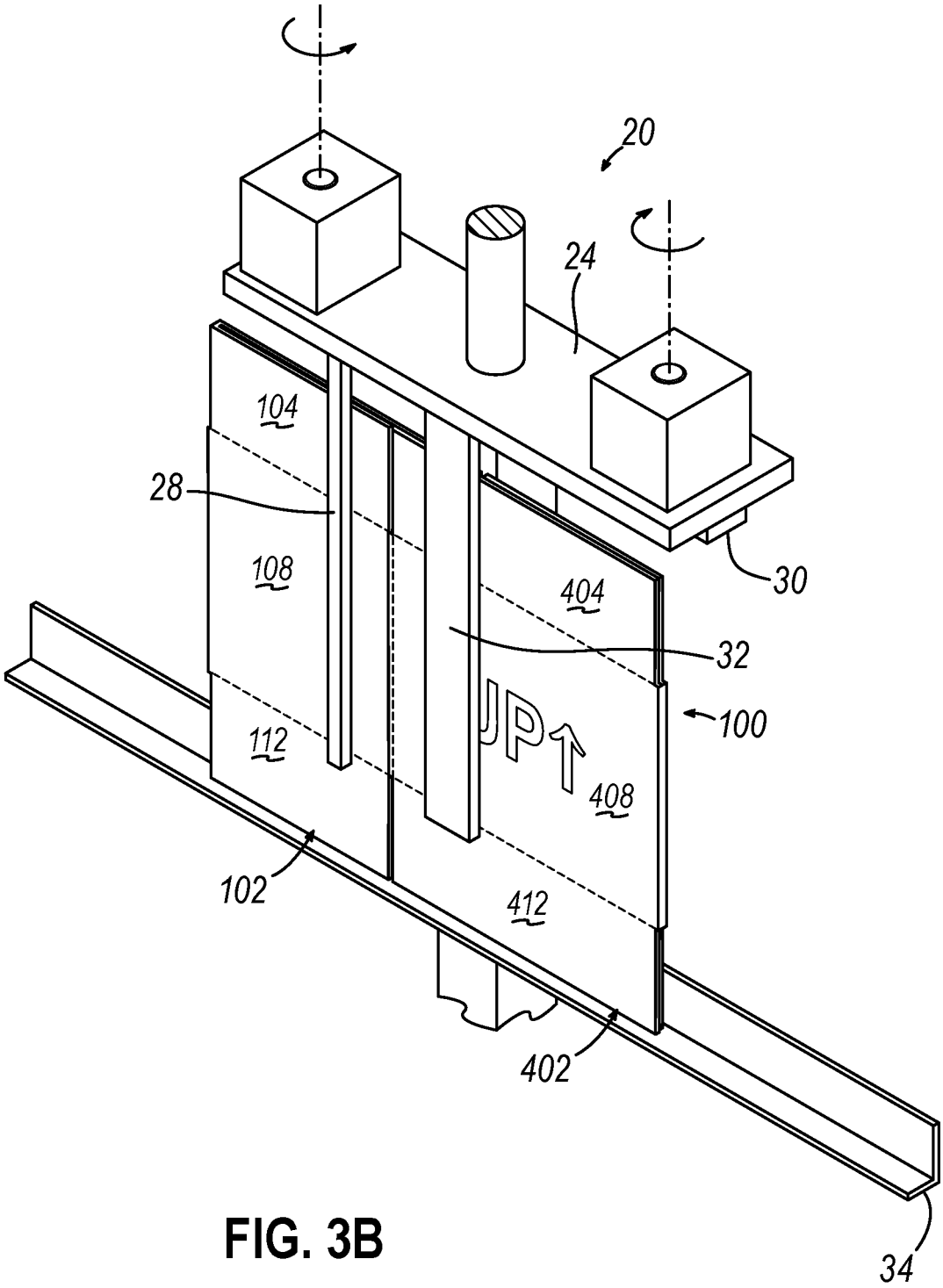
FIG. 3B is a front perspective view of the outer panels of the case blank of FIG. 1 being folded inward by the folding device of FIG. 2C.
Figure 3C:
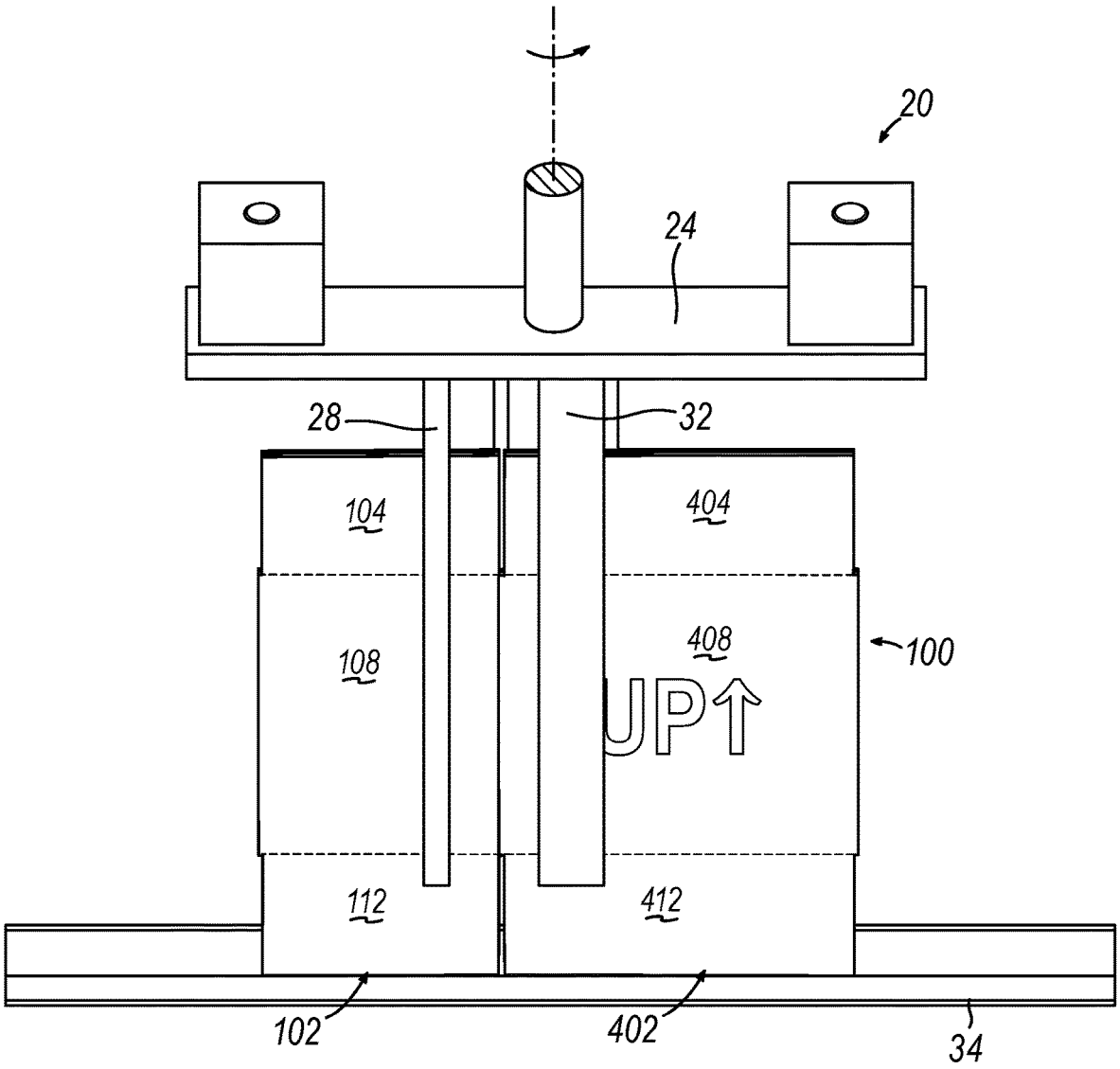
FIG. 3C a top perspective view of the outer panels of the case blank of FIG. 1 being folded inward by the folding device of FIG. 2C.
Figure 3D:
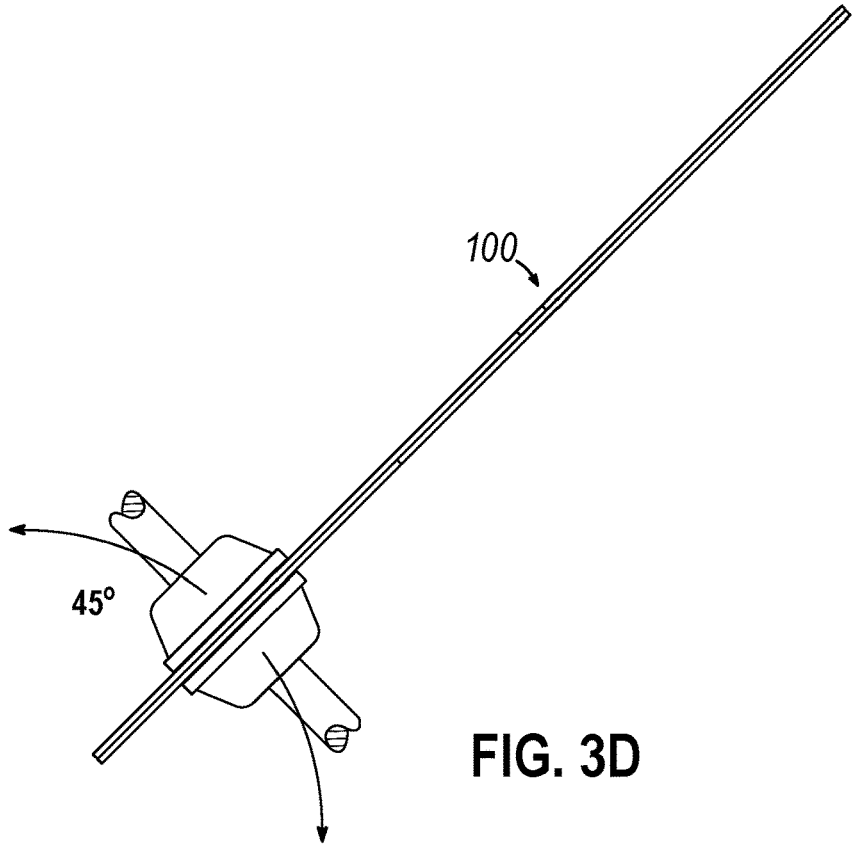
FIG. 3D depicts the folded case blank of FIGS. 3B-3D turned at a predetermined angle and placed within a case opening device.

As shown in FIG. 2C, example forming device 20 includes central vertical support 22 upon which horizontal upper support 24 is mounted. First hinged arm 26, which includes vertical rod 28 is rotatably mounted on horizontal upper support 24 and second hinged arm 30, which includes vertical bar 32, is also rotatably mounted on horizontal upper support 24. First hinged arm 26 and second hinged arm 30 are each driven in an inward direction by a motor or other force-producing device mounted on horizontal upper support 24. Horizontal lower support 34 is mounted on central vertical support parallel to horizontal upper support 24. Vacuum assembly 36 is also mounted on central vertical support 22 and includes horizontal support 38 upon which first vertical support 40 is mounted. Upper vacuum head 42 and lower vacuum head 44 are mounted on first vertical support 40. Second vertical support 46 is mounted on horizontal support 38 and upper vacuum head 48 and lower vacuum head 50 are mounted on second vertical support 46. Vacuum assembly 36 retains case blank 100 in a vertical orientation and an optional horizontal lower support 34 supports the case blank from the bottom. As shown in FIGS. 3A-3C, vertical rod 28 and vertical bar 32 contact the outer panels of an unfolded case blank 100 (i.e., the outside major (408) and minor (108) panels) and when forming device 20 is activated, fold the panels inward 180 degrees from their starting position to compress and form the manufacturer's joint on the case.

Figure 3E:
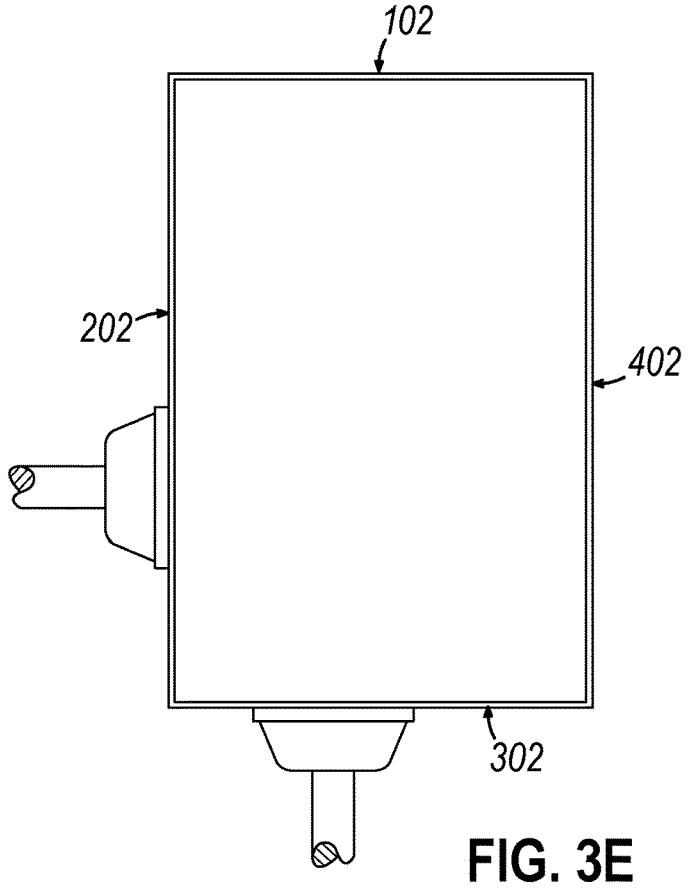
FIG. 3E depicts the flat case blank of FIG. 3D in an open case configuration.
Figure 3F:
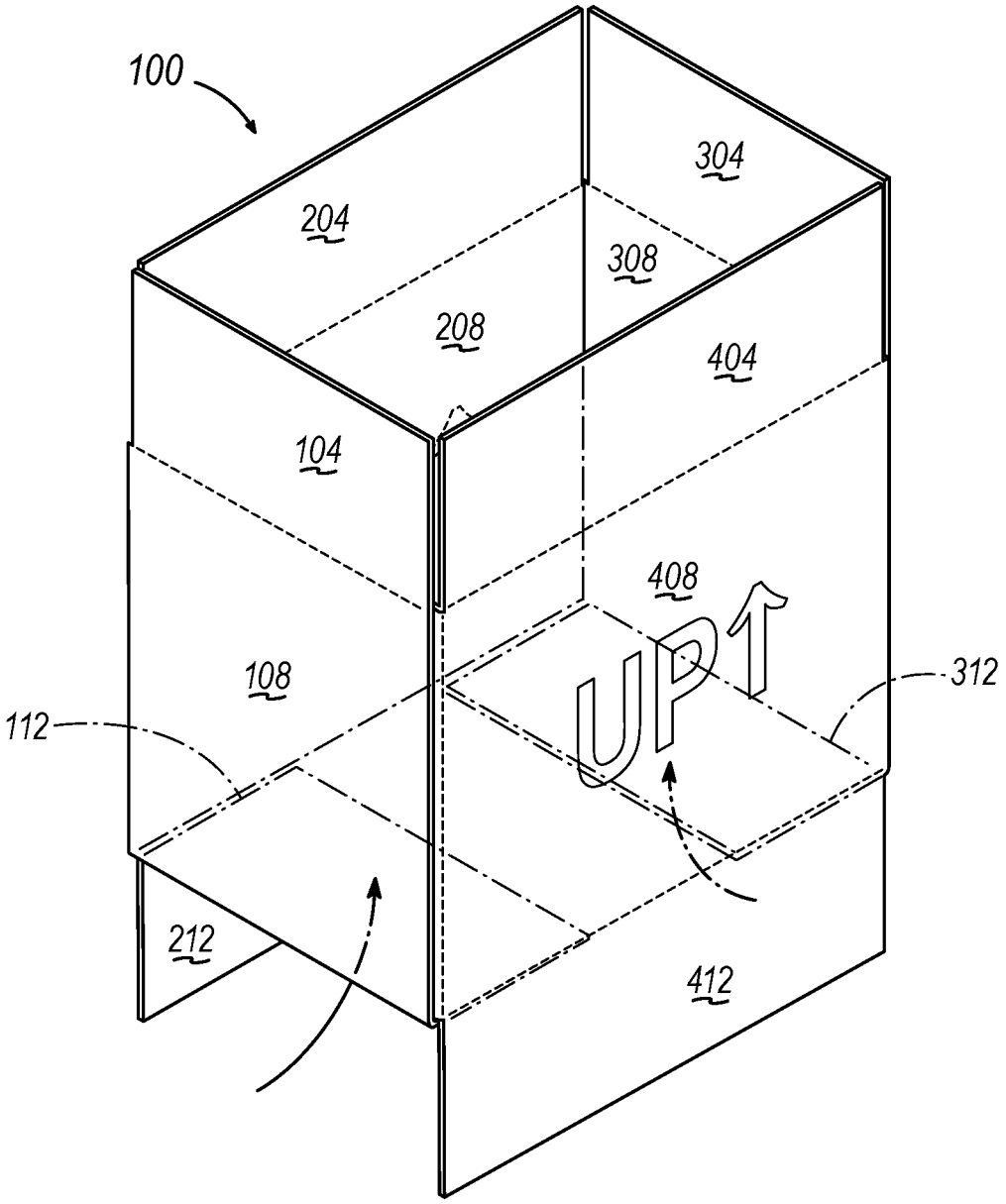
FIG. 3F depicts the open case of FIG. 3E wherein the bottom minor flaps thereof have been folded upward.
Figure 3G:
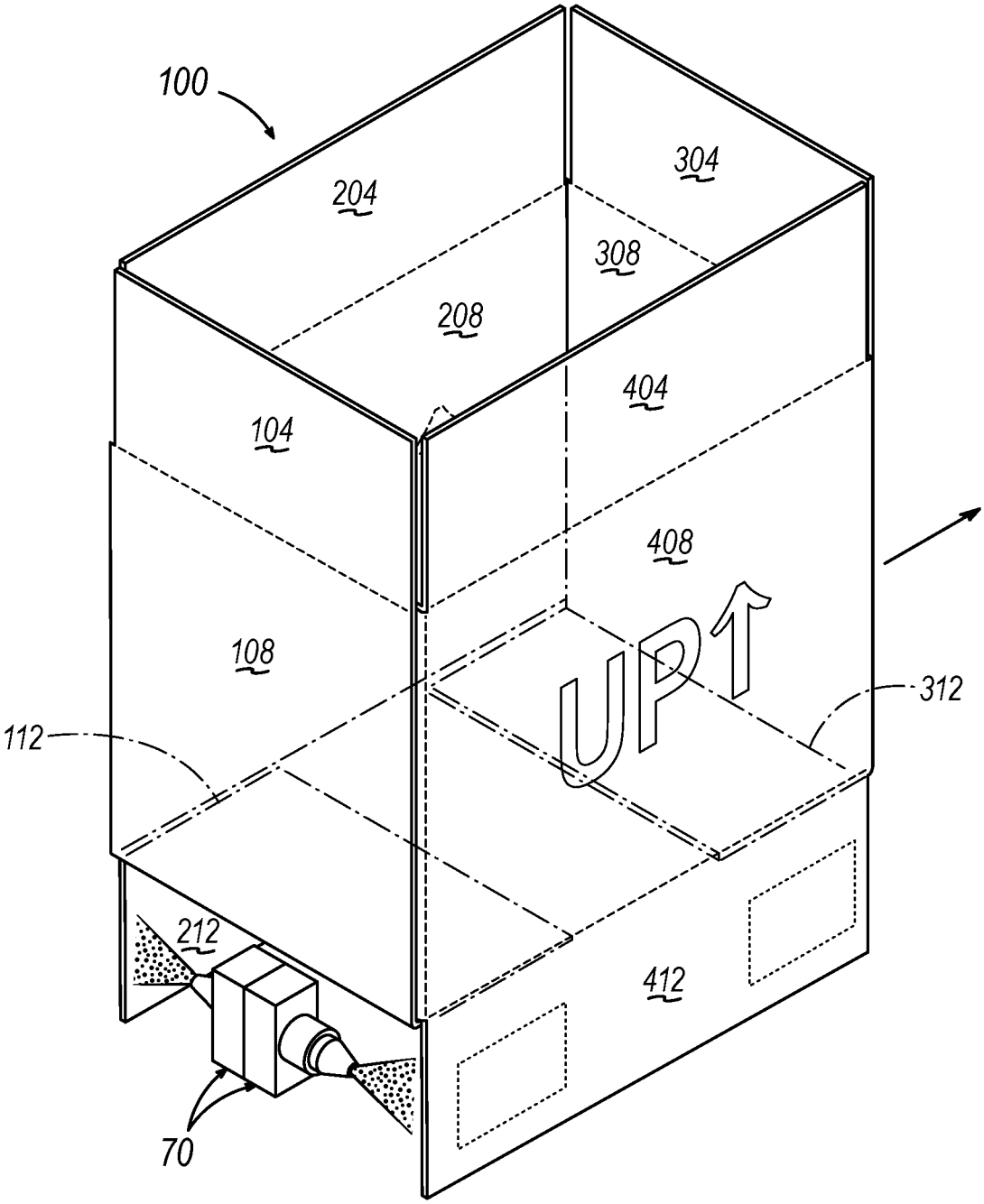
FIG. 3G depicts the open case of FIG. 3F wherein adhesive is being applied to the bottom major flaps thereof.
Figure 3H:
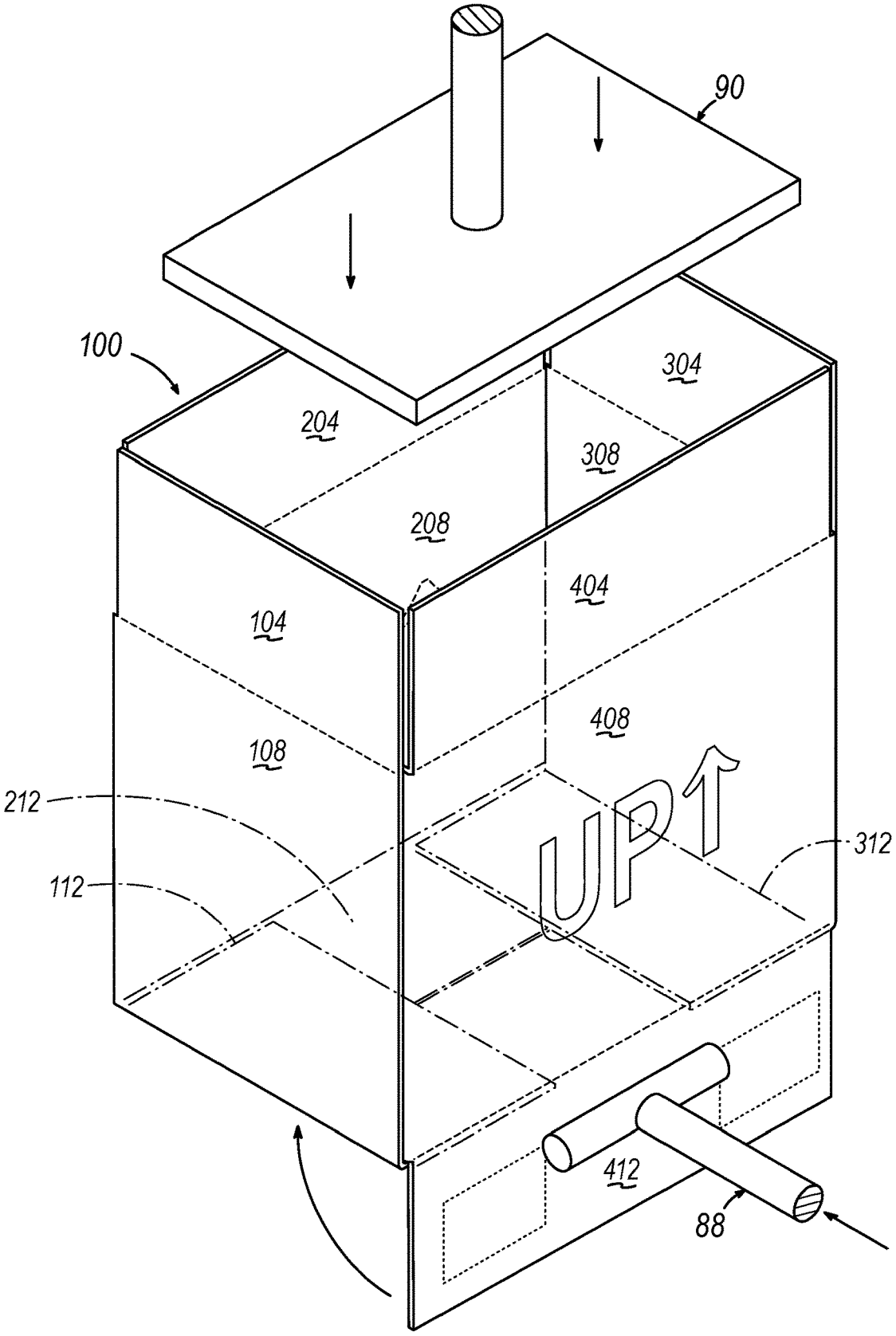
FIG. 3H depicts the open case of FIG. 3G wherein the bottom flaps are being folded upward by a folding mechanism and wherein pressure is about to be applied to the bottom flaps of the case by a compression mandrel.
Figure 3I:
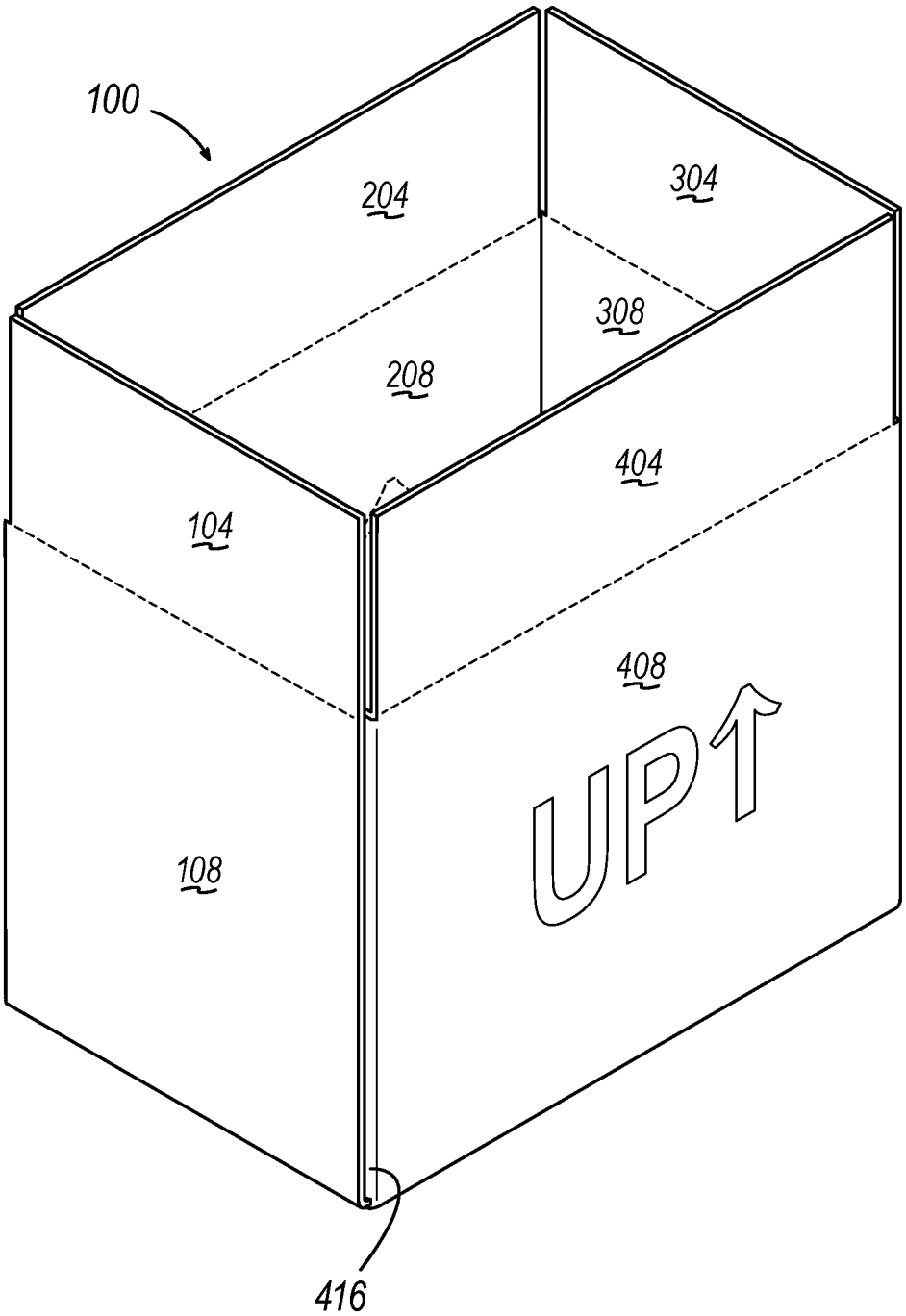
FIG. 3I is a perspective view of a case formed by the disclosed case forming system and method.

After the adhesive applied to manufacturer's joint tab 416 has adequately cured, forming device 20 turns the partially assembled or knocked down case about 45° (See FIG. 3D) and lowers it vertically into a case opening device (see FIG. 3E). Case opening device 80 grips the partially assembled case, forming device 20 releases the knocked down case, and forming device 20 travels upward and away from the case opening device. As shown in FIG. 3E, the case opening device opens the flattened case and as shown in FIG. 3F, a minor flap folding mechanism folds minor bottom flap 112 and minor bottom flap 312 into a closed position. A retractable case side guide (not shown) extends to guide the side of the case, which is then indexed forward by a flight bar mechanism (not shown). The case then passes over two adhesive applicators 70 that apply hot melt glue or similar adhesive to major bottom flap 212 and major bottom flap 412 (see FIG. 3G). The partially assembled case is then stopped in a compression station where major flap folding mechanism 88 folds major bottom flap 212 and major bottom flap 412 into a closed position (See FIG. 3H). Compression mandrel 90 is then lowered into the assembled case for applying pressure to the glued regions of the case and to ensure that the edges of the case are square. After a predetermined time during which the adhesive cures, compression mandrel 90 retracts and the formed case is indexed out of or discharged from the case processing machine and onto a discharge conveyer (see FIG. 3I).

Figure 4:
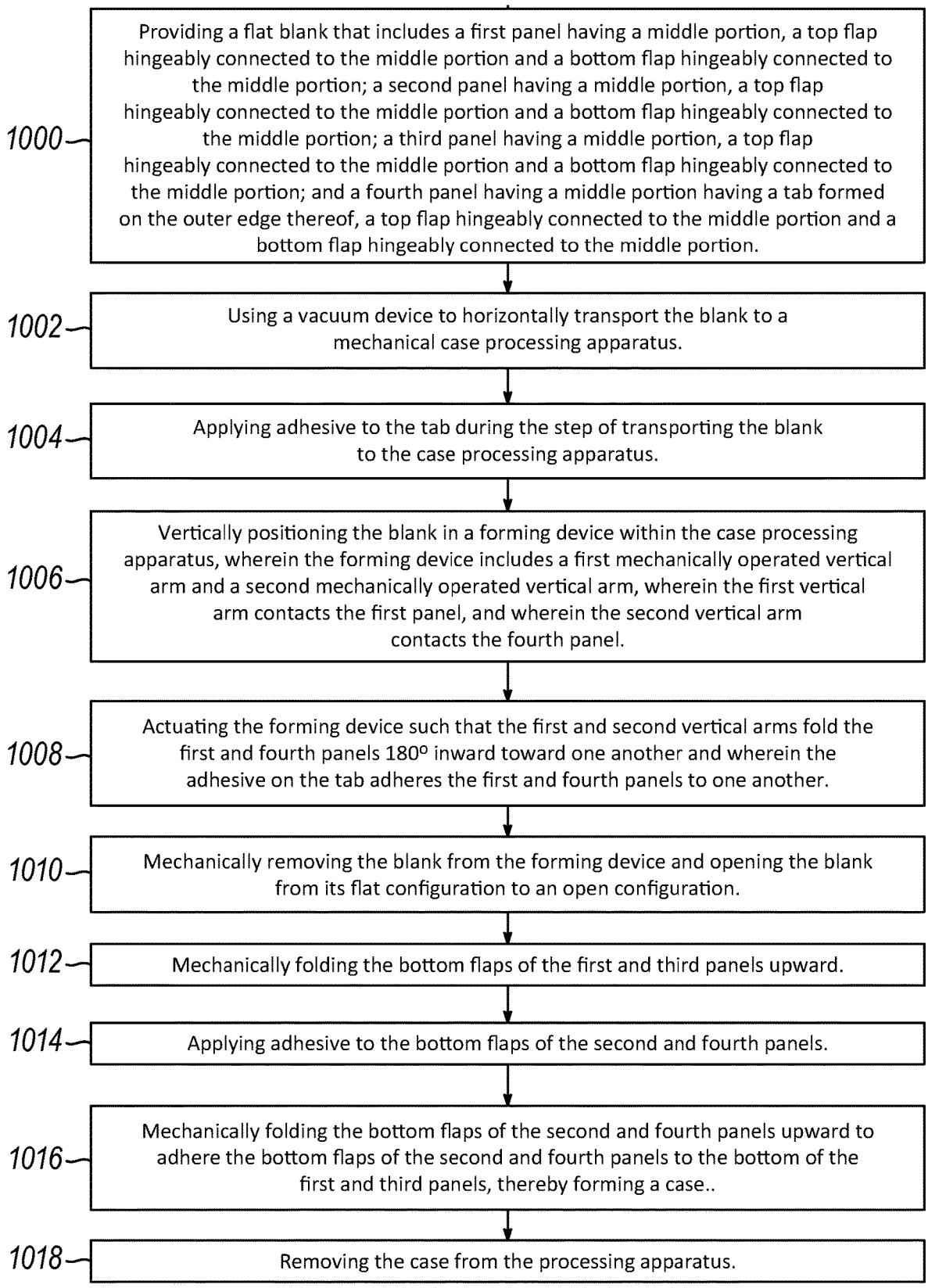
FIG. 4 is a flow chart of an example method for forming a case using the disclosed case forming system.

FIG. 4 provides a flow chart of an example method for forming a case using the disclosed case forming system. Step 1000 includes providing a flat blank that includes a first panel having a middle portion, a top flap hingeably connected to the middle portion and a bottom flap hingeably connected to the middle portion; a second panel having a middle portion, a top flap hingeably connected to the middle portion and a bottom flap hingeably connected to the middle portion; a third panel, having a middle portion, a top flap hingeably connected to the middle portion and a bottom flap hingeably connected to the middle portion; and a fourth panel having a middle portion having a tab formed on the outer edge thereof, a top flap hingeably connected to the middle portion, and a bottom flap hingeably connected to the middle portion. Step 1002 includes using a vacuum device (or other type of gripping device) to horizontally transport the blank to a mechanical case processing apparatus. Step 1004 includes applying adhesive to the tab during the step of transporting the blank to the case processing apparatus. Step 1006 includes vertically positioning the blank in a forming device within the case processing apparatus, wherein the forming device includes a first mechanically operated vertical arm and a second mechanically operated vertical arm, wherein the first vertical arm contacts the first panel, and wherein the second vertical arm contacts the fourth panel. Step 1008 includes actuating the forming device such that the first and second vertical arms fold the first and fourth panels 180° inward toward one another and wherein the adhesive on the tab adheres the first and fourth panels to one another. Step 1010 includes mechanically removing the blank from the forming device and opening the blank from its flat configuration to an open configuration. Step 1012 includes mechanically folding the bottom flaps of the first and third panels upward. Step 1014 includes applying adhesive to the bottom flaps of the second and fourth panel; Step 1016 includes mechanically folding the bottom flaps of the second and fourth panels upward to adhere the bottom flaps of the second and fourth panels to the bottom flaps of the first and third panels, thereby forming a case. Finally, step 1018 includes removing the case from the processing apparatus.

The disclosed systems, device, and methods provide various advantages over prior art systems including: material cost savings, e.g., a per-carton cost savings when purchasing pre-glued knock-down cartons or cases as compared to flat die-cut blanks; shipping cost savings with more efficient trailer loads being possible; equipment cost savings because complex case-specific mandrels used with other carton forming systems are not required; and cartons that may be produced on-demand at the point of use from flat die-cut blanks, thereby resulting in improved material and handling economics.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated references and similar materials differs from or contradicts this application, including but not limited to defined terms, term usage, described techniques, or the like, this application controls.

As previously stated and as used herein, the singular forms "a," "an," and "the," refer to both the singular as well as plural, unless the context clearly indicates otherwise. The term "comprising" as used herein is synonymous with "including," "containing," or "characterized by," and is inclusive or open-ended and does not exclude additional, unrecited elements or method steps. Although many methods and materials similar or equivalent to those described herein can be used, particular suitable methods and materials are described herein. Unless context indicates otherwise, the recitations of numerical ranges by endpoints include all numbers subsumed within that range. Furthermore, references to "one implementation" are not intended to be interpreted as excluding the existence of additional implementations that also incorporate the recited features. Moreover, unless explicitly stated to the contrary, implementations "comprising" or "having" an element or a plurality of elements having a particular property may include additional elements whether or not they have that property.

The terms "substantially" and "about" used throughout this specification are used to describe and account for small fluctuations, such as due to variations in processing. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%, and/or 0%.

Underlined and/or italicized headings and subheadings are used for convenience only, do not limit the disclosed subject matter, and are not referred to in connection with the interpretation of the description of the disclosed subject matter. All structural and functional equivalents to the elements of the various implementations described throughout this disclosure that are known or later come to be known to those of ordinary skill in the art are expressly incorporated herein by reference and intended to be encompassed by the disclosed subject matter. Moreover, nothing disclosed herein is intended to be dedicated to the public regardless of whether such disclosure is explicitly recited in the above description.

There may be many alternate ways to implement the disclosed inventive subject matter. Various functions and elements described herein may be partitioned differently from those shown without departing from the scope of the disclosed inventive subject matter. Generic principles defined herein may be applied to other implementations. Different numbers of a given module or unit may be employed, a different type or types of a given module or unit may be employed, a given module or unit may be added, or a given module or unit may be omitted. For example, in alternate example implementations, the first and fourth panels are joined to one another using mechanical binding devices and methods such as staples, rivets, or the like in addition to the use of adhesive(s) or as alternatives to the use of adhesive(s).

It should be appreciated that all combinations of the foregoing concepts and additional concepts discussed in greater detail herein (provided such concepts are not mutually inconsistent) are contemplated as being part of the disclosed inventive subject matter. In particular, all combinations of claimed subject matter appearing at the end of this disclosure are contemplated as being part of the inventive subject matter disclosed herein. The disclosed inventive subject matter has been illustrated by the description of example implementations, and while the example implementations have been described in certain detail, there is no intention to restrict or in any way limit the scope of the appended claims to such detail. Additional advantages and modifications will readily appear to those skilled in the art. Therefore, the disclosed inventive subject matter in its broader aspects is not limited to any of the specific details, representative devices and methods, and/or illustrative examples shown and described. Accordingly, departures may be made from such details without departing from the spirit or scope of the general inventive concept.

What is claimed:

1. An automated system for forming pre-glued case blanks, comprising:

(a) positioning an unfolded die-cut blank in a forming device, (i) wherein the unfolded blank includes a) a first panel, wherein the first panel includes a middle portion, a top flap hingeably connected to the middle portion and a bottom flap hingeably connected to the middle portion;

b) a second panel, wherein the second panel includes a middle portion, a top flap hingeably connected to the middle portion and a bottom flap hingeably connected to the middle portion;

c) a third panel, wherein the third panel includes a middle portion, a top flap hingeably connected to the middle portion and a bottom flap hingeably connected to the middle portion; and d) a fourth panel, wherein the fourth panel includes a middle portion having a tab formed on the outer edge thereof, a top flap hingeably connected to the middle portion, and a bottom flap hingeably connected to the middle portion;

(ii) wherein the forming device includes a) a first mechanically operated arm that directly contacts the first panel;

b) a second mechanically operated arm that directly contacts the fourth panel; and c) a first support upon which a second support is mounted, d) wherein the first mechanically operated arm and the second mechanically operated arm are both rotatably mounted on the second support, e) wherein the first mechanically operated arm and the second mechanically operated arm are each driven in an inward direction by motors or other force-producing devices mounted the second support;

(b) applying adhesive to the tab; and (c) actuating the forming device such that the first and second arms fold the first and fourth panels 180° inward toward one another, wherein the adhesive on the tab adheres the first and fourth panels to one another; and wherein the first and fourth panels lie flat against the second and third panels thereby forming a flat pre-glued knock-down case blank on the forming device.

2. The system of claim 1, further comprising using a blank wherein the first and third panels have the same width and wherein the second and fourth panels have the same width and wherein the width of the second and fourth panels is either greater than the width of the first and third panels, less than the width of the first and third panels, or the same as the width of the first and third panels.

3. The system of claim 1, further comprising a vacuum device or other type of device for transporting the unfolded blank to the forming device and a mechanical device for applying the adhesive.

4. The system of claim 1, wherein the adhesive includes a thermoplastic material.

5. The system of claim 1, wherein the forming device does not include a mandrel; and wherein the forming devoice is integrated into a case processing apparatus.

6. The system of claim 1, further comprising a gripping assembly mounted on the support of the forming device for retaining the flat blank during the folding process.

7. An automated system for forming pre-glued case blanks, comprising:

(a) positioning an unfolded die-cut blank in a mandrel-less forming device that has been integrated into a case processing apparatus, (i) wherein the unfolded blank includes a) a first panel, wherein the first panel includes a middle portion, a top flap hingeably connected to the middle portion and a bottom flap hingeably connected to the middle portion;

b) a second panel, wherein the second panel includes a middle portion, a top flap hingeably connected to the middle portion and a bottom flap hingeably connected to the middle portion;

c) a third panel, wherein the third panel includes a middle portion, a top flap hingeably connected to the middle portion and a bottom flap hingeably connected to the middle portion; and d) a fourth panel, wherein the fourth panel includes a middle portion having a tab formed on the outer edge thereof, a top flap hingeably connected to the middle portion, and a bottom flap hingeably connected to the middle portion; and (ii) wherein the mandrel-less forming device includes a) a first support upon which a second support is mounted;

b) a first mechanically operated arm rotatably mounted on the second support;

c) a second mechanically operated arm rotatably mounted on the second support, d) wherein the first mechanically operated arm and the second mechanically operated arm are each driven in an inward direction by motors or other force-producing devices mounted the second support; and e) wherein the first arm directly contacts the first panel, and wherein the second arm directly contacts the fourth panel;

(b) applying a material that includes thermoplastic adhesive to the tab; and (c) actuating the forming device such that the first and second arms fold the first and fourth panels 180° inward toward one another, wherein the adhesive on the tab adheres the first and fourth panels to one another; and wherein the first and fourth panels lie flat against the second and third panels thereby forming a flat pre-glued known-down case blank on the forming device.

8. The system of claim 7, further comprising using a blank wherein the first and third panels have the same width and wherein the second and fourth panels have the same width and wherein the width of the second and fourth panels is either greater than the width of the first and third panels, less than the width of the first and third panels, or the same as the width of the first and third panels.

9. The system of claim 7, further comprising a vacuum or other type of device for transporting the unfolded blank to the mandrel-less forming device and a mechanical device for applying the adhesive.

10. The system of claim 7, further comprising a gripping assembly mounted on the support of the mandrel-less forming device for retaining the unfolded blank during the folding process.

* * * * *